United States Patent [19]

Osborne et al.

[11] Patent Number: 4,626,168

[45] Date of Patent: Dec. 2, 1986

[54] DIFFUSER FOR CENTRIFUGAL COMPRESSORS AND THE LIKE

[75] Inventors: Colin Osborne, Allegany; Peter N. Chow, Olean, both of N.Y.

[73] Assignee: Dresser Industries, Inc., Dallas, Tex.

[21] Appl. No.: 734,571

[22] Filed: May 15, 1985

[51] Int. Cl.[4] ..... F04D 29/30

[52] U.S. Cl. ..... 415/211; 415/219 A

[58] Field of Search ..... 415/181, 199.1, 199.2, 415/199.3, 211, 219 A, 207

[56] References Cited

U.S. PATENT DOCUMENTS

| | | | |
|---|---|---|---|
| 2,836,347 | 5/1958 | Barr et al. | 415/211 X |
| 2,925,952 | 2/1960 | Garve | 415/211 |
| 3,644,055 | 2/1972 | Davis | 415/211 |
| 3,658,437 | 4/1972 | Soo | 415/211 X |
| 3,781,128 | 12/1973 | Bandukwalla | 415/211 |
| 4,354,802 | 10/1982 | Nishida et al. | 415/211 |
| 4,378,194 | 3/1983 | Bandukwalla | 415/211 X |
| 4,395,197 | 6/1983 | Yoshinaga et al. | 415/211 |
| 4,421,457 | 12/1983 | Yoshinaga et al. | 415/211 |

FOREIGN PATENT DOCUMENTS

| | | | |
|---|---|---|---|
| 709266 | 7/1941 | Fed. Rep. of Germany | 415/219 A |
| 359619 | 10/1931 | United Kingdom | 415/219 A |
| 522343 | 9/1976 | U.S.S.R. | 415/211 |
| 572586 | 9/1977 | U.S.S.R. | 415/211 |

*Primary Examiner*—Robert E. Garrett
*Assistant Examiner*—Joseph M. Pitko

[57] ABSTRACT

The improved diffuser includes pinching a portion of a diffuser flow passageway that has ribs therein extending partially across the diffuser passageway and that have their leading edges located away from the inlet of the diffuser passageway. The diffuser passageway is pinched from the diffuser inlet to the leading edge of the ribs to provide improved flow angle alignment and the leading edges of the ribs been moved away from the impeller to avoid buffeting and noise as the compressed gas leaves the impeller and enters the annular diffuser passageway.

9 Claims, 7 Drawing Figures

DIFFUSER FOR CENTRIFUGAL COMPRESSORS AND THE LIKE

BACKGROUND OF THE INVENTION

This invention relates generally to centrifugal compressors. More particularly, but not by way of limitation, this invention relates to a diffuser for a centrifugal compressor that includes a plurality of ribs located in a diffuser passageway.

In any centrifugal compressor as the fluid flow exits the impeller, the flow distribution is distorted. Specifically, such distorted flow is characterized by a low angle (relative to a tangent to the impeller circumference) fluid flow exiting most prominently adjacent to the shroud side of the diffuser. In the past, this distorted flow has been shown to cause severe compressor preformance problems.

In an attempt to alleviate the foregoing, vanes or ribs have been located in the diffuser passageways, as clearly shown in U.S. Pat. No. 4,395,197 issued July 26, 1983 to Yoshinaga et al and in U.S. Pat. No. 4,421,457 issued Dec. 20, 1983 to Yoshinaga et al. It will be noted in those patents that ribs, as distinguished from vanes, have been located in the diffuser passageways. (Ribs do not extend entirely across the passageway. Vanes do.)

It will also be noted in those patents that the leading edges of the ribs are located extremely close to the outlet or outer diameter of the impeller. Accordingly, such ribs are subjected to the shock loading and pounding resulting from pressure fluctuations created as the impeller blades move past the ribs. Such pressure is imposed on both the ribs and impeller blades. It is believed that such pounding may, therefore, result in fatigue of the ribs and of the blades, significant noise levels, and increased flow disturbance.

It should also be pointed out, however, that locating the ribs in this manner can aid in increasing the flow angle adjacent to the shroud side of the diffuser and thus increases the efficiency of the compressors in which they are located. However, the primary effect of the ribs is to redirect the low angle flow immediately adjacent to them, but will not redirect the low angle flow at all positions between adjacent ribs particularly at radii near the diffuser inlet. This creates the potential for reverse flow into the impeller with resulting performance degradation.

In FIGS. 7 and 7A of the '457 patent, there is also illustrated a tapered diffuser passageway that is provided with diffuser ribs. The tapered diffuser passageway, as illustrated therein, is of uniform taper starting with the largest dimension adjacent to the impeller outlet and tapering inwardly to the diffuser outlet.

An object of this invention is to provide an improved diffuser for centrifugal compressors that increases the efficiency of the compressors by providing a more uniform flow through the diffuser and incorporates features that substantially reduce the buffeting, noise, and shock loading of the diffuser ribs and of the impeller blades.

SUMMARY OF THE INVENTION

This invention then provides an improved diffuser for a centrifugal compressor that has an inner diameter sized to receive the impeller and that includes an annular diffuser passageway arranged in general radial alignment with the outlet of the impeller. More specifically, the passageway is a "pinched" passageway reducing in width at a varied rate upon progressing radially outward from an inlet to an outlet. In particular, an intermediate passageway portion is located between the inlet and the outlet and is of less axial width than the axial width of the impeller outlet. In a more detailed aspect, the invention is characterized by a plurality of circumferentially spaced ribs located in the diffuser passageway with leading edges of the ribs positioned in the intermediate portion of the passageway remote both from the outlet of the impeller and the inlet of the diffuser passageway.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
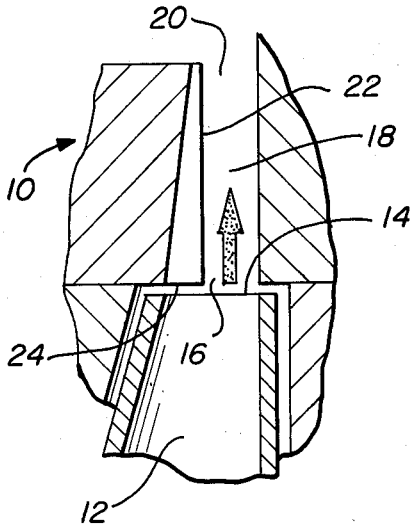
FIG. 1 PRIOR ART
FIG. 1 is a fragmentary cross-sectional view illustrating one prior constructed ribbed diffuser arrangement.

Referring to the drawing, and to FIG. 1 in particular, shown therein is a fragmentary view of a compressor as shown in the prior art that is designated by the reference character 10. The compressor 10 includes an impeller 12 that is journaled in the compressor 10. The impeller 12 has an outlet 14 disposed adjacent to an inlet 16 of an annular diffuser passageway 18. It will be noted that the diffuser passageway 18 is tapered from the inlet 16 to an outlet 20 thereof. Located in the passageway 18 is a plurality of ribs 22 that have their leading edges 24 located at the inlet 16 of the diffuser passageway 18. It will also be noted that the inlet 16 is very close to the outlet 14 of the impeller 12.

Figure 2:
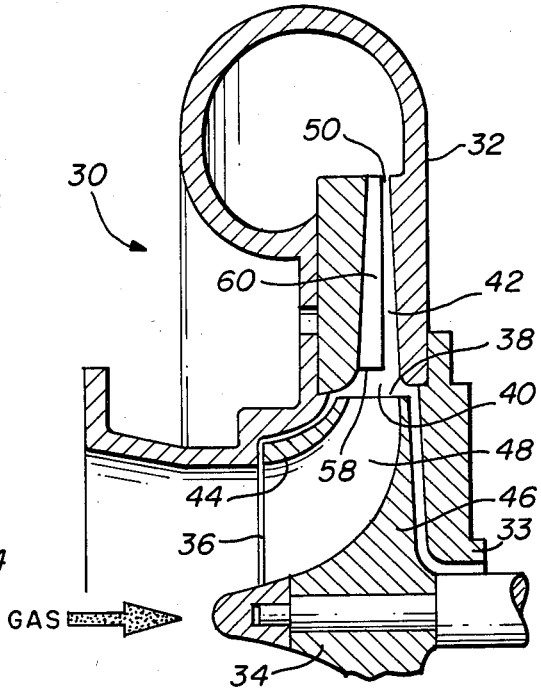
FIG 2 is a fragmentary cross-sectional view of the centrifugal compressor incorporating a diffuser that is constructed in accordance with the invention.

The fragmentary cross-sectional view of FIG. 2 illustrates a compressor that is generally designated by the reference character 30 which is constructed in accordance with the invention. The compressor 30 includes a diffuser 32 and an impeller 34 that is journaled in a compressor housing 33. The impeller 34 includes an inlet 36 and an outlet 38 that is disposed immediately adjacent to and in radial alignment with an inlet 40 into an annular diffuser passageway 42 formed in the diffuser 32. The impeller 34 also includes a shroud or cover 44 and a hub 46 that are held in spaced relationship by a plurality of blades 48.

Figure 3:
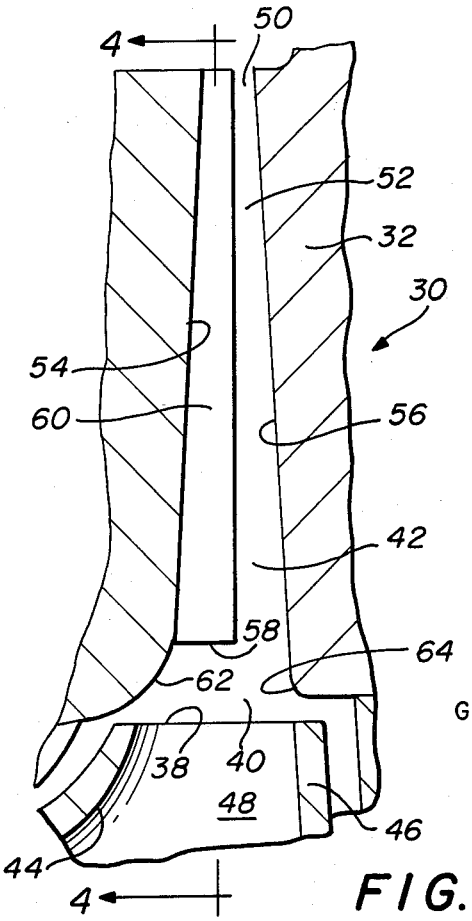
FIG. 3 is an enlarged fragmentary cross-sectional view of the outer peripheral portion of the impeller and illustrating in more detail the structure of the diffuser that is constructed in accordance with the invention.
Figure 4:
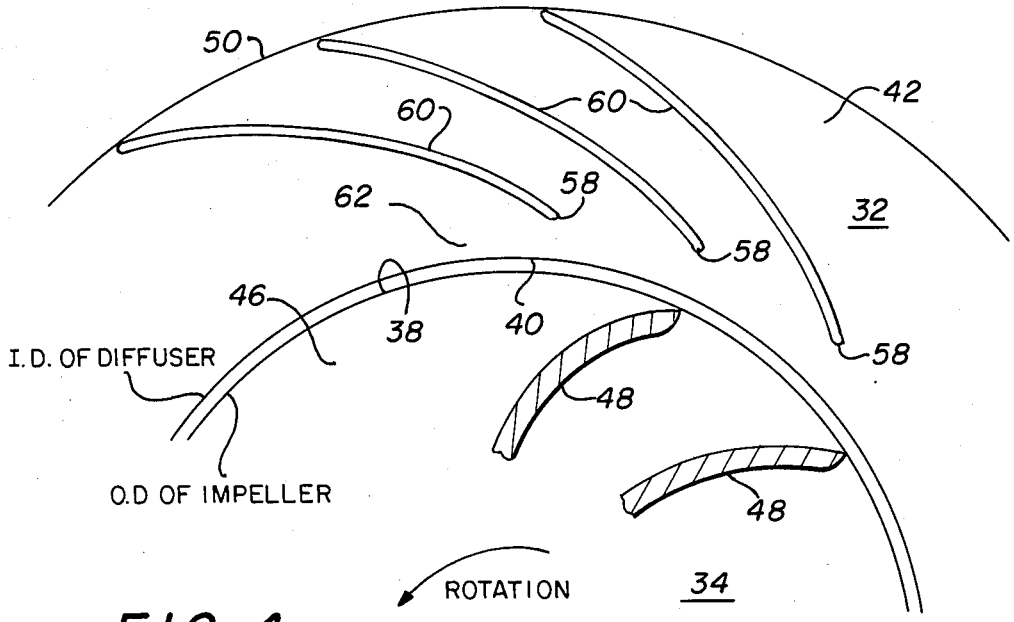
FIG 4 is a cross-sectional view taken generally along line 4—4 of FIG. 3.

The enlarged fragmentary views of FIGS. 3 and 4 illustrate in more detail the structural arrangement ot the diffuser 30 and of the impeller 34. In addition to the inlet 40, the diffuser passageway 42 includes an outlet 50 and disposed between the outlet 50 and the inlet 40 is an intermediate portion 52. The diffuser passageway 42 is annular in configuration and is defined by a shroud surface 54 and a hub surface 56 which are in general alignment with inner surfaces on the shroud 44 and hub 46 of the impeller 34.

In particular the passageway 42 is a "pinched" passageway in that the rate of reduction in passageway width (see FIG. 3) varies upon progressing from the inlet 40 thereof to the outlet 50. The shroud surface 54 extends from the inlet 40 of the diffuser passageway 42 to a leading edge 58 on a diffuser rib 60 and is provided with a curved or "pinched" surface 62. The hub surface 56 is similarly provided with a curved or "pinched" surface 64. As can be seen in FIG. 3, the surface 62 adjacent to the shroud surface 54 is pinched substantially greater than the pinch of the surface 64 located adjacent to the hub surface 56.

The approach of the surfaes 62 and 64 toward each other is at a much greater rate than the linear taper of the passageway 42 existing downstream of the leading edge 58. From beginning to end of such surfaces, the "pinch" may be in a range of from 15% to 60% of the width of the impeller outlet 38 such that substantially over half of the total passageway pinch exists upstream of the leading edge 58.

The surfaces 54 and 56 are illustrated as being disposed at an angle relative to each other thereby defining a tapered annular diffuser passageway 42. Manifestly, the surfaces 54 and 56 may be parallel to each other if desired.

The location of the leading edges of vanes, as distinguished from ribs, has been traditionally defined by multiplying the outer diameter of the impeller 34 by a factor of from 1.06 to about 1.2. The factor varies depending on the operating parameters of the compressor 30. Accordingly, the location of the leading edges 58 of the ribs 60 may also be determined.

In operation, the impeller 34 is appropriately driven by an engine or motor (not shown). Gas passing through the inlet 36 of the impeller is driven by the impeller blades 48 through the outlet 38 thereof. In the case of the compressor 10 shown in FIG. 1, the gas impinges immediately upon the leading edge of the rib 22 so that the fluctuating pressures generated as each blade 12 passes each rib 22, create a condition for potential shock loading, and pounding to fatigue the ribs 22 and blades 12 and cause significant noise and flow disturbance, which all detrimentally impact the desired preformance of the compressor.

Figure 6:
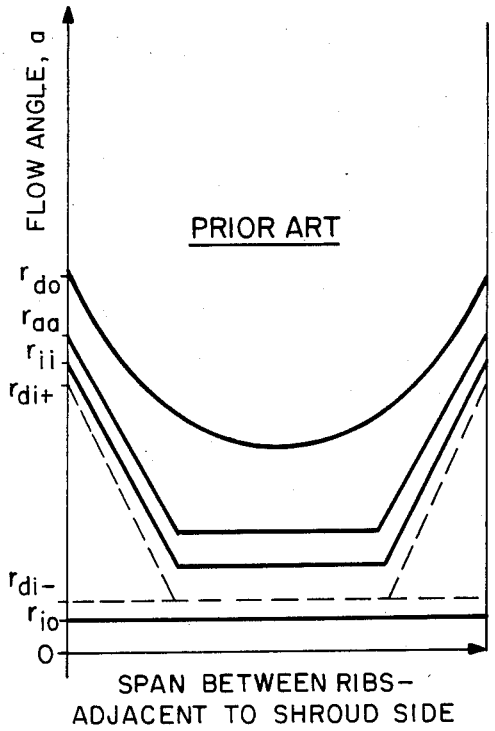
FIG. 6 is a simplified, graphic representation illustrating flow angle distribution of the FIG. 1 prior art construction as taken between adjacent ribs and at various radial locations adjacent to the shroud side of the diffuser passageway.

The compressor 10 can be provided with only a finite number of ribs 22 in the diffuser. As shown by FIG. 6, the flow angle distribution adjacent to the shroud wall and between ribs 22 of the FIG. 1 prior art arrangement varies between adjacent ribs. In FIG. 6, the flow angle 'a' increases upwardly on the the graphs and the right and left-hand sides of the graph represent the facing walls of adjacent ribs so that the span between rib is represented by the distance between sides of the graph. The lower line labelled $r_{io}$ represents an idealized graph of the flow angle taken between the ribs at the impeller outlet. Similarly, the graph lines labelled $r_{di-}$ and $r_{di+}$ are representative graphs of the flow angles taken immediately before and immediately after the leading edges of the two adjacent ribs 22. Lines $r_{ii}$ and $r_{aa}$ are intermediate graphs taken at selected radially outward locations and line $r_{do}$ is a representative graph of the flow angle at the outlet of the diffuser passage 18. As may be seen by comparing the graph lines $r_{di-}$ and $r_{di+}$, the flow angle in the center of the area between the ribs is essentially unchanged immediately downstream of the leading edge of the ribs 22 while adjacent to each rib the flow angle is changed substantially. In the intermediate location $r_{ii}$, the graph droops substantially between the ribs creating the potential as diffusion occurs and pressure is increased to cause a reversal of gas flow toward the impeller, resulting in a loss of compressor performance. This effect is carried through to the diffuser outlet with a substantial droop still being clearly shown in the graph $r_{do}$.

In the case of the compressor 30 shown in FIG. 2, the leading edges 58 of the ribs 60 have been retracted substantially and the impact of the pressure fluctuations on the ribs 60 and on the blades 48 is substantially reduced thereby, if not eliminated. Also, the compressor 30 provides the "pinched" initial diffuser passageway to maintain the flow angle closer to the design value of flow angle to improve the efficiency of the compressor 10 while avoiding the potential damage from pressure fluctuations that is present in the compressor 10 due to the location of the leading edges 24 of the ribs 22.

Figure 5:
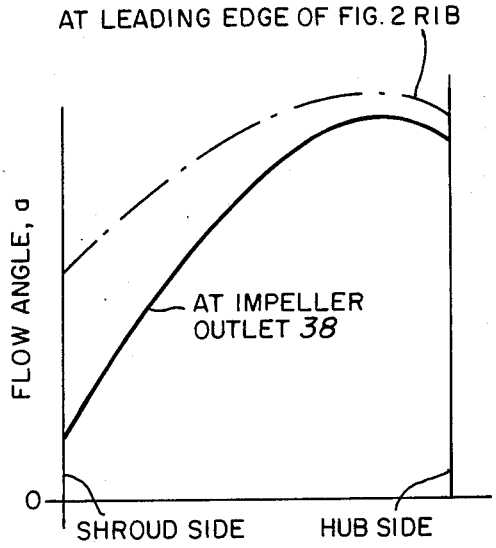
FIG. 5 is a graphic representation comparing the angular flow distribution axially across the impeller outlet and the leading edges of the diffuser ribs constructed in accordance with the invention.

FIG. 5 illustrates, by the dash-dot line, the distribution of the gas flow angles at the leading edge 58 of the rib 60 as measured from the tangential to the impeller circumference. This flow angle distribution is to be compared with the flow angle distribution at the impeller outlet 38 which is shown by the solid line. It can be seen that the effect of the surfaces 62 and 64 is to improve the flow angle of the gas in the diffuser as compared to that exiting from the impeller.

Figure 7:
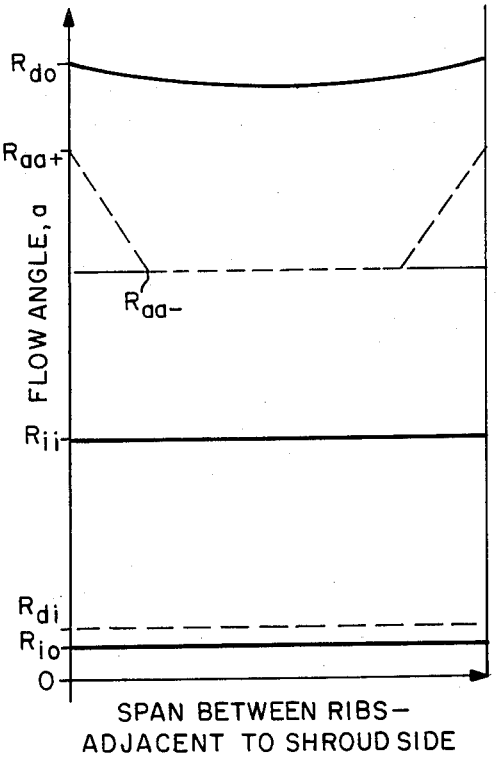
FIG. 7 is a view similar to FIG. 6, but illustrating the flow angle distributions taken at approximately the same radial positions in the diffuser arrangement of the present invention.

FIG. 7 is similar to FIG. 6 and illustrates improved idealized flow angle curves at radial locations comparable to those shown in FIG. 6, but within the diffuser passageway 42. In particular, because of the "pinched" configuration of surface 62, the flow angle a is seen to be constant at each radius regardless of circumferential position, but increasing in magnitude as the radius increases up to the rib leading edges 58. As in FIG. 6, $R_{io}$represents the flow angle of gas exiting the impeller over a annular span on the surface 62 equal to the distance between the ribs 23 and $R_{di}$ represents the flow angle distribution at the diffuser inlet 40. $R_{ii}$ is an intermediate position taken at a radius equal to the radius for $r_{ii}$. Specifically, this position is located upstream of the radial positions of the leading edges 58. The graphs $R_{aa-}$ and $R_{aa+}$ are taken at radial positions virtually equal to the radial position of $r_{aa}$ and are positions located immediately upstream and immediately downstream of the radial location of the leading edges 58 of the ribs 60. From a comparison of FIGS. 6 and 7, it is readily seen that, the flow angles in the passageway 42 of exemplary compressor 30 are increased uniformly and immediately and with less initial radial pressure gardient are combining to reduce the propensity for flow reversal. Moreover the flow incidence variation occurring at the rib leading edge 58 clearly is substantially reduced over the flow incidence variation occurring at the leading edge 24 of the prior art rib 22 so as to reduce incidence losses and chances of flow separation.

Still further, the graph $R_{do}$ is maintained with substantially less droop and therefore provides a more uniform flow angle distribution. This clearly indicates the improvement in compressor efficiency resulting from the combination effect of the withdrawal of the edge 58 away from the impeller 48 and the "pinching" of the inlet 40 of the diffuser passageway is readily apparent.

As a side benefit of the improved flow angles and of the reduction in buffeting, redesign of the ribs is possible. The ribs can be reduced in height thereby reducing the cantilever loading that pressure impulses may impose as they strike the ribs. The blade height reduction increases the natural frequency of ribs so as to help avoid resonance frequency problems in compressors designed with high blade passing frequencies. Also, the length, that is the radial extent, of the ribs may be reduced providing less friction in the diffuser and providing some increase in compressor efficiency.

Accordingly, it can be seen that the compressor described in detail hereinbefore incorporating a diffuser that is constructed in accordance with the invention provides a much improved flow angle distribution and reduces the buffeting of the ribs and blades to improve compressor efficiency and structural integrity.

Having described but a single embodiment of the invention, it will be understood that many changes and modifications can be made thereto without departing from the spirit or scope of the annexed claims.

What is claimed is:

1. In a centrifugal compressor including a bladed impeller journaled for rotation about a rotational axis of a housing having improved diffuser means located adjacent to the outlet of the impeller, said improved diffuser means having an inner diameter sized to receive said impeller and including:

an annular diffuser passageway in general radial alignment with the outlet of said impeller, said passageway having an inlet, outlet, and an intermediate portion, said intermediate portion being of less axial width than said impeller outlet; and, a plurality of circumferentially spaced ribs located in said diffuser passageway, said ribs having leading edges located in said intermediate portion and remote from the outlet of said impeller and from the inlet of said diffuser passageway and closer to the inlet of said diffuser passageway than to said outlet;

said impeller including a hub and a shroud with blades disposed therebetween;

said diffuser means including a shroud surface in said diffuser passageway located adjacent to said impeller shroud and a hub surface in said diffuser passageway located adjacent to said impeller hub;

said hub surface being generally aligned with said hub;

said shroud surface being disposed at an angle relative to said hub surface; and, said ribs projecting from said shroud surface toward said hub surface in circumferential spaced relationship.

2. In a centrifugal compressor including a bladed impeller journaled for rotation about a rotational axis of a housing and generating an area of low angle flow an improved diffuser means located adjacent to the outlet of the impeller, said improved diffuser means having an inner diameter sized to receive said impeller and including:

an annular diffuser passageway in general alignment with the outlet of said impeller, said passageway having an inlet, outlet, and an intermediate portion, said intermediate portion being of less axial width than said impeller outlet;

a plurality of circumferentially spaced ribs located in said diffuser passageway and extending axially into, but not substantially past the low angle flow area, and having leading edges located in said intermediate portion and remote from the outlet of said impeller and from the inlet of said diffuser passageway;

a hub surface in said diffuser passageway generally aligned with said hub;

a shroud surface in said diffuser passageway located opposite said hub surface and disposed at an angle relative thereto whereby said passageway reduces in axial width upon progressing radially outward from said inlet thereof; and, said reduction in axial width of said passageway acting in conjunction with said ribs to increase the low angle flow, making the entire gas flow through said passageway more uniform without substantially changing the angle of gas flow outside of said low angle flow area.

3. The diffuser means of claim 2 wherein said ribs project from said shroud surface toward said hub surface and are arranged in circumferential spaced relationship.

4. The diffuser means of claim 2 wherein at least a portion of said reduction in passageway width is accomplished by pinch occurring between the leading edges of said ribs and the inlet of said diffuser passageway.

5. The diffuser means of claim 4 wherein said pinch is generally between 15 and 60 percent of the axial width of the outlet of said impeller.

6. The diffuser means of claim 5 wherein the leading edges of said ribs are located on diameter in said passageway that is generally between 1.06 and 1.2 times the diameter of said impeller.

7. A method for increasing the efficiency of a centrifugal compressor having a rotor that generates low angle gas flow over a portion of the rotor outlet area, the method comprising the steps of:

locating ribs in a diffuser passageway of the compressor with said ribs projecting axially into but not substantially past the low angle flow portion, with the leading edges of the ribs located away from said rotor outlet, said ribs increasing the low flow gas angle therebetween within said diffuser passageway; and pinching the inlet portion of said diffuser passageway adjacent to the low angle flow portion and upstream of said ribs to increase the low angle of gas flow uniformly around the entire circumference of said rotor upstream of said leading edges.

8. A method for increasing the angle of gas passing through the diffuser passageway of a centrifugal compressor having a rotor that generates low angle gas flow over a portion of the rotor outlet area and aligning the gas flow therethrough the method comprising the steps of:

locating ribs in the passageway with their leading edges spaced downstream from the passageway inlet and having the ribs extending axially into the low angle gas flow area a distance substantially equal to the extent of the low angle gas flow; and converging the inlet portion of the diffuser passageway upstream of said ribs and adjacent to the rotor outlet on the surface thereof juxtaposed to the low angle gas flow area in the diffuser passageway to increase the gas flow angle between said ribs and prior to encountering said ribs.

9. In a centrifugal compressor including a bladed impeller journaled for rotation about a rotational axis of a housing having improved diffuser means located adjacent to the outlet of the impeller, said improved diffuser means having an inner diameter sized to receive said impeller and including:

an annular diffuser pasageway in general alignment with the outlet of said impeller, said passageway being defined by axially spaced shroud and hub surfaces and having an inlet, outlet, and an intermediate portion, said intermediate portion being of less axial width than said impeller outlet;

a plurality of circumferentially spaced ribs located in said diffuser passageway, said ribs having leading edges located in said intermediate portion and remote from the outlet of said impeller and from the inlet of said diffuser passageway; and, said diffuser passageway being pinched substantially greater adjacent said shroud surface in comparison to any pinch adjacent said hub surface side, and said pinch occurring substantially upstream of said leading edges of said ribs.

* * * * *